US007752759B2

(12) United States Patent
Perreault

(10) Patent No.: US 7,752,759 B2
(45) Date of Patent: Jul. 13, 2010

(54) FOLDING KNIFE AND RELATED METHODS

(76) Inventor: Daniel C. Perreault, 1924 165th Court SE, Bellevue, WA (US) 98008

( * ) Notice: Subject to any disclaimer, the term of this patent is extended or adjusted under 35 U.S.C. 154(b) by 797 days.

(21) Appl. No.: 11/336,410

(22) Filed: Jan. 19, 2006

(65) Prior Publication Data

US 2006/0168819 A1 Aug. 3, 2006

Related U.S. Application Data

(60) Provisional application No. 60/645,545, filed on Jan. 19, 2005.

(51) Int. Cl.
*B26B 1/04* (2006.01)

(52) U.S. Cl. ..... 30/161; 30/155

(58) Field of Classification Search ..... 30/155, 30/160, 161

See application file for complete search history.

(56) References Cited

U.S. PATENT DOCUMENTS

| | | | | |
|---|---|---|---|---|
| 436,888 | A * | 9/1890 | Bultzingslowen et al. | 30/159 |
| 5,025,557 | A * | 6/1991 | Perreault | 30/151 |
| 5,029,354 | A * | 7/1991 | Boyd et al. | 7/118 |
| 5,095,624 | A * | 3/1992 | Ennis | 30/161 |
| 5,425,175 | A * | 6/1995 | Rogers | 30/161 |
| 5,490,332 | A * | 2/1996 | Levin | 30/161 |
| 5,964,035 | A | 10/1999 | Poehlmann | |
| 6,338,431 | B1 * | 1/2002 | Onion | 30/161 |
| 6,378,214 | B1 | 4/2002 | Onion | |
| 6,427,334 | B2 | 8/2002 | Onion | |
| 6,553,672 | B2 | 4/2003 | Glesser et al. | |
| 6,675,484 | B2 * | 1/2004 | McHenry et al. | 30/161 |
| 2006/0283021 | A1 * | 12/2006 | Chu | 30/155 |
| 2007/0137047 | A1 * | 6/2007 | Kim | 30/161 |

FOREIGN PATENT DOCUMENTS

FR 2 610 237 * 5/1988

* cited by examiner

*Primary Examiner*—Hwei-Siu C Payer
(74) *Attorney, Agent, or Firm*—Joshua King; Graybeal Jackson LLP

(57) ABSTRACT

A folding knife comprises a lock configured to more securely hold the blade in an extended position than conventional locks of conventional knives. The folding knife includes a handle, a blade movable relative to the handle to an extended position, and the lock that retains the blade in the extended position. The blade includes a cutting edge, and a tang that has a cavity and that is attached to the handle and pivotable about a pivot axis. The cavity includes a central axis parallel or substantially parallel with the pivot axis and that is located a distance away from the pivot axis that is greater than the distance between the pivot axis and the end of the handle. The lock includes a pin moveable relative to the handle and insertable into the cavity to retain the blade in an extended position. The lock holds the blade more securely by contacting the blade a further distance away from the location where the blade is attached to the handle than the distance between the same two locations of a conventional folding knife.

5 Claims, 7 Drawing Sheets

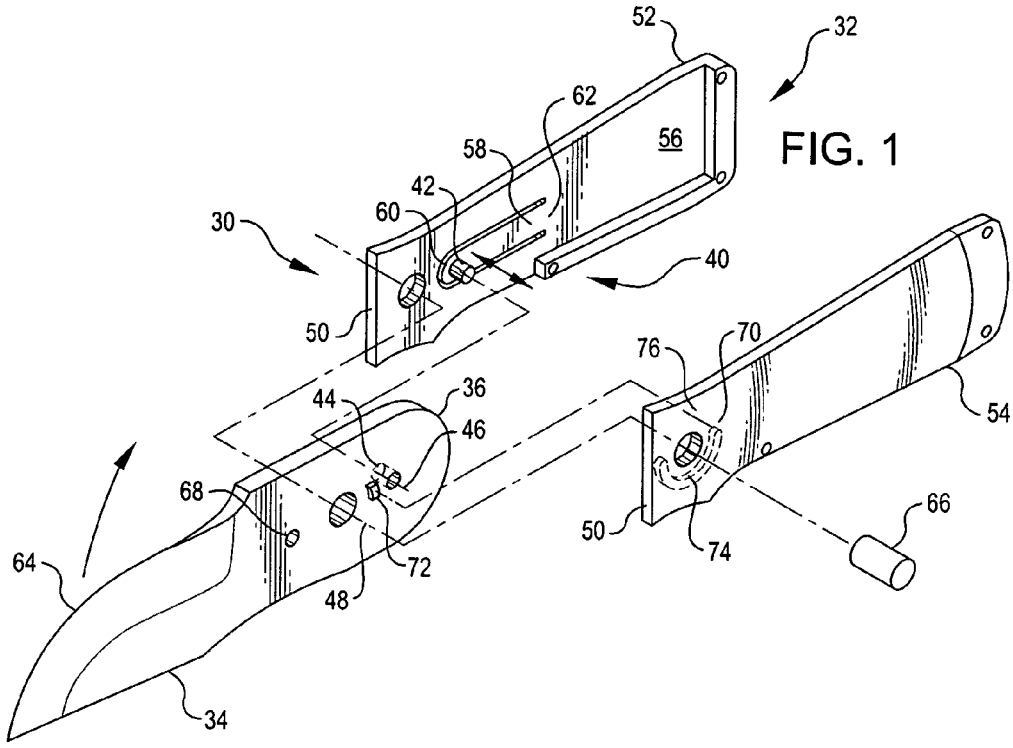
FIG. 1
FIG. 2A
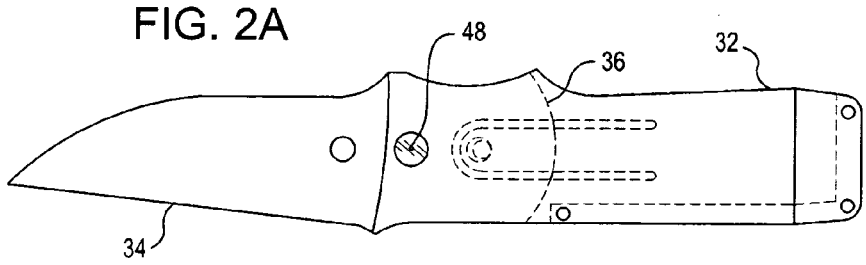
FIG. 2B
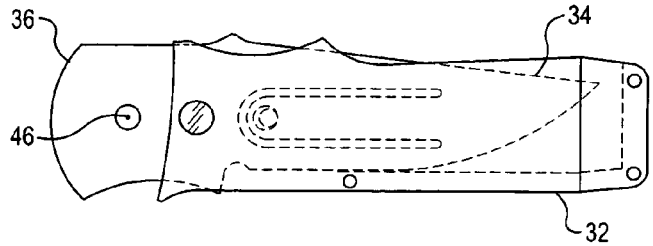

FOLDING KNIFE AND RELATED METHODS

CROSS-REFERENCE TO RELATED APPLICATIONS

This application claims priority from commonly owned U.S. Provisional Patent Application 60/645,545, filed 19 Jan. 2005, and titled Folding Knife, which is incorporated herein by reference in its entirety and for all its teachings and disclosures.

BACKGROUND

Folding knives typically include a handle and a blade that pivots relative to an end of the handle. When the blade is not being used, the blade is usually pivoted to a retracted position where the cutting edge of the blade is disposed in a slot in the handle. When the blade is being used, the blade is usually pivoted to an extended position where the cutting edge of the blade is exposed. Most folding knives also include a locking mechanism to lock the blade in the extended position. The locking mechanism primarily protects a user's fingers by preventing the unintentional retraction of the blade during use.

A typical locking mechanism includes a notch or flat surface near the pivot axis of the blade that is typically engaged by a bolt or catch to prevent the blade from pivoting. Unfortunately, due to the short distance typically provided between the pivot axis and the notch, a given torque, when applied to a blade that is locked, will create substantial forces on the locking mechanism thereby causing the mechanism to loosen, wear, or fail.

Furthermore, because the blade is typically fixed to the handle at only two points when locked (the pivot axis and the notch), the blade is susceptible to wobble and play when lateral or torsional forces are applied. As the mechanism wears, the blade becomes more susceptible to wobble and play.

In part because of the limitations described above, current folding knives are often too weak to withstand substantial force, and a rigid, one-piece knife must be used. However, one-piece knives require the use of a scabbard for safety, and the knife may not be converted to a more compact form for storage.

In view of the above, there is a need for improved folding knives and related methods that provide improved locking and better blade stability.

SUMMARY

One aspect of the invention provides a folding knife that comprises a lock configured to more securely hold the blade in an extended position than conventional locks of conventional knives. The folding knife includes a handle, a blade attached to the handle and movable relative to the handle to an extended position, and the lock that retains the blade in the extended position. The lock holds the blade more securely by contacting the blade a further distance away from the location where the blade is attached to the handle than the distance between the same two locations of a conventional folding knife. By increasing the distance, the amount of force that the lock must exert on the blade to hold the blade in the extended position can be reduced. Thus, the lock can better hold the blade when a significant torque is applied to the blade, and better resist wear during use.

In some embodiments of the invention, the folding knife comprises a handle that has an end, a blade and a lock. The blade includes a cutting edge, and a tang that has a cavity and that is attached to the handle and pivotable relative to the handle about a pivot axis. The cavity includes a central axis parallel or substantially parallel with the pivot axis and that is located a distance away from the pivot axis that is greater than the distance between the pivot axis and the end of the handle. The lock includes a pin moveable relative to the handle and insertable into the cavity to retain the blade in an extended position. When the blade is in the extended position, the cutting edge is exposed for cutting, and when the blade is in a retracted position the cutting edge is concealed to prevent cutting.

In other embodiments of the invention, the folding knife comprises a handle that has an end, a blade and a lock. The blade includes a cutting edge, and a tang that has a pin and that is attached to the handle and pivotable relative to the handle about a pivot axis. The pin includes a central axis parallel or substantially parallel with the pivot axis and that is located a distance away from the pivot axis that is greater than the distance between the pivot axis and the end of the handle. The lock includes a block moveable relative to the handle and positionable over the pin to retain the blade in an extended position. When the blade is in the extended position, the cutting edge is exposed for cutting, and when the blade is in a retracted position the cutting edge is concealed to prevent cutting.

In still other embodiments of the invention, the folding knife comprises a handle that has an end, a blade and a lock. The blade includes a cutting edge, and a tang that has a pin with a slot, and that is attached to the handle and pivotable relative to the handle about a pivot axis. The pin includes a central axis parallel or substantially parallel with the pivot axis and that is located a distance away from the pivot axis that is greater than the distance between the pivot axis and the end of the handle. The lock includes a rod moveable relative to the handle and insertable into the slot to retain the blade in an extended position. When the blade is in the extended position, the cutting edge is exposed for cutting, and when the blade is in a retracted position the cutting edge is concealed to prevent cutting.

In another aspect of the invention, a method for locking in an extended position a blade that is attached to a handle of a knife comprises: a) pivoting to the extended position, the blade relative to the handle about a pivot axis; and b) inserting a pin of a lock of the knife into a cavity of a tang of the blade to retain the blade in the extended position, wherein the cavity has a central axis parallel or substantially parallel with the pivot axis and located a distance away from the pivot axis that is greater than the distance between the pivot axis and an end of the handle.

In other embodiments of the invention, a method for locking in an extended position a blade that is attached to a handle of a knife comprises: a) pivoting to the extended position, the blade relative to the handle about a pivot axis; and b) positioning a block of a lock of the knife over a pin of a tang of the blade to retain the blade in the extended position, wherein the pin has a central axis located a distance away from the pivot axis that is greater than the distance between the pivot axis and an end of the handle.

In still other embodiments of the invention, a method for locking in an extended position a blade that is attached to a handle of a knife comprises: a) pivoting to the extended position, the blade relative to the handle about a pivot axis; and b) inserting a rod of a lock of the knife into a slot of a pin of a tang of the blade to retain the blade in the extended position, wherein the pin has a central axis located a distance away from the pivot axis that is greater than the distance between the pivot axis and an end of the handle.

BRIEF DESCRIPTION OF THE FIGURES

FIG. 1 is an exploded, perspective view of a folding knife according to an embodiment of the invention.

FIG. 2A is a view of the folding knife in FIG. 1 with the blade locked in an extended position according to an embodiment of the invention.

FIG. 2B is a view of the folding knife in FIG. 1 with the blade locked in a retracted position according to an embodiment of the invention.

DETAILED DESCRIPTION

Figure 3:
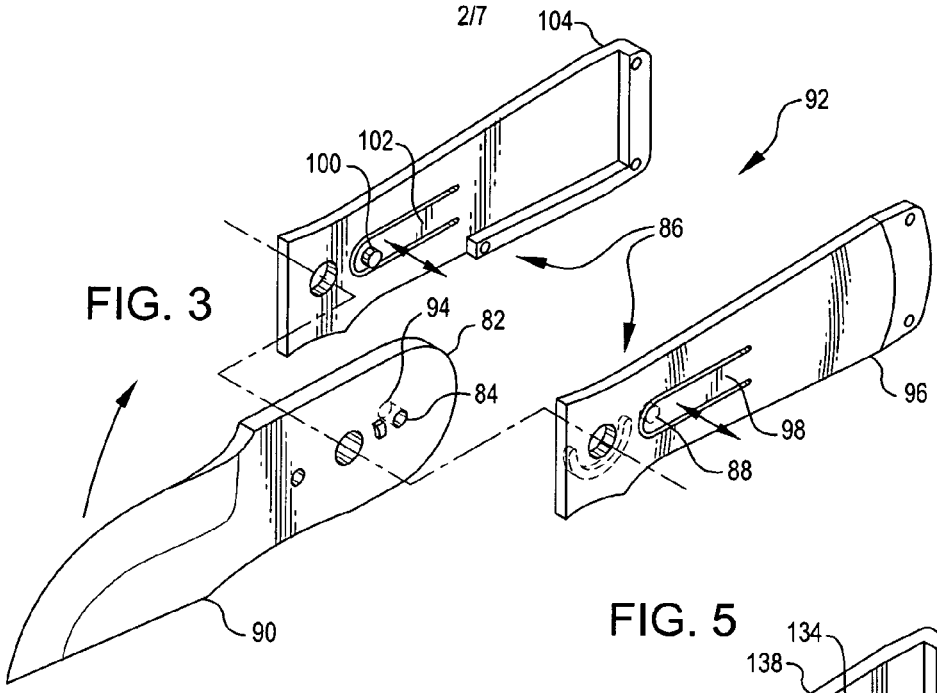
FIG. 3 is an exploded, perspective view of a folding knife according to another embodiment of the invention.

Various modifications to the disclosed embodiments will be readily apparent and the generic principles herein may be applied to other embodiments and applications without departing from the spirit and scope of the present discussion. Thus, the present discussion is not intended to be limited to the embodiments shown, but is to be accorded the widest scope consistent with the principles and features disclosed herein.

One aspect of the invention provides a folding knife that comprises a lock configured to more securely hold the blade in an extended position than conventional locks of conventional knives. The folding knife includes a handle, a blade attached to the handle and movable relative to the handle to an extended position, and the lock that retains the blade in the extended position. The lock holds the blade more securely by contacting the blade a further distance away from the location where the blade is attached to the handle than the distance between the same two locations of a conventional folding knife. By increasing the distance, the amount of force that the lock must exert on the blade to hold the blade in the extended position can be reduced. Thus, the lock can better hold the blade when a significant torque is applied to the blade, and better resist wear during use.

In some embodiments (FIGS. 1-10) the lock includes a pin that is inserted into a cavity of the blade to retain the blade in an extended position. In other embodiments (FIGS. 11A-16), the lock includes a block that is positioned over a pin of the blade to retain the blade in the extended position. In still other embodiments (FIGS. 17-23), the lock includes a rod that is inserted into a slot of a pin of the blade to retain the blade in the extended position.

FIG. 1 is an exploded, perspective view of a folding knife 30 according to an embodiment of the invention. The knife 30 includes a handle 32, and a blade 34 having a tang 36 attached to the handle 32 and pivotable about a pivot axis 48 so that the blade 34 can be moved to an extended position (discussed in greater detail in conjunction with FIG. 2A) and a retracted position (discussed in greater detail in conjunction with FIG. 2B). The knife 30 also includes a lock 40 to retain the blade 34 in the extended and retracted positions. The lock 40 includes a pin 42 that, when the blade 34 is in an extended position, is inserted into a cavity 44 (here a hole) in the tang 36 to retain the blade 34 in the extended position. The cavity 44 has a central axis 46 whose distance from the pivot axis 48 is greater than the distance between the end 50 of the handle 32 and the pivot axis 48.

Most conventional folding knives have a tang that does not extend beyond the end of the handle when the blade is in the retracted position (similar to FIG. 2B) so that the tang can pass by a blade stop located at the end of the handle. The stop typically prevents the blade from pivoting beyond the desired extended position and may help lock the blade in the extended position. Because the length of most conventional blade tangs is limited by the location of the stop, the lock of these conventional knives cannot contact the tang at a location whose distance is greater than the distance between the pivot axis of the blade and the end of the handle. Thus, the distance between the pivot axis 48 and the central axis 46 is greater than the distance between similar axes of a conventional knife. By increasing the distance between the central axis 46 and the pivot axis 48, the pin 42 can exert less force on the tang 36 to oppose a torque exerted on the portion of the blade 34 extending away from the handle 32.

The handle 32 includes a first side 52 and a second side 54. The sides may be releasably attached to each other using any desired conventional fasteners such as screws (not shown), or the sides 52 and 54 may not be releasably attached to each other, that is they may be integral to each other. The first side 52 includes a body 56, and a portion 58 having an end 60 that is moveable relative to the body 56 and from which the pin 42 extends. The portion 58 extends from a region 62 of the body 56 and is configured to locate the pin 42 such that the pin 42 is disposed in the cavity 44 when the blade 34 is in an extended position, for example the fully extended position where the blade 34 is substantially aligned with the handle 32. The portion 58 and/or region 62 can elastically bend to insert the pin 42 into the hole 44 when the blade 34 is in the extended position, and to allow the blade 34 to be moved to other positions relative to the handle 32. Thus, the portion 58 can be a spring configured to hold the pin 42 in the hole 44 without requiring an external force, when the blade 34 is in the extended position.

The material, shape, length, width and thickness of the portion 58 and region 62 may be configured as desired to provide a desired resistance to being elastically bent. For example the portion 58 and region 62 can be made from titanium, spring steel, NiTinol, or other suitably elastically flexible material. Increasing the thickness of the portion 58 and region 62 causes their stiffness to increase requiring more force to elastically bend them to move the pin 42.

The portion 58 may be attached to the body 56 using any desired fastening technique. For example, in an embodiment the portion 58 may be integral with the body 56, that is not releasably attached. The region 62 may be located anywhere in the handle 32 and may include two or more separate regions, such as a first region (not shown) from which a first leg (not shown) extends, and a second region (not shown) from which a second leg (not shown) extends.

Still referring to FIG. 1, the pin 42 may be any desired shape that allows it to be inserted into cavity 44. For example, in an embodiment the pin 42 is cylindrical and extends the width of the tang 36 when inserted into the hole 44 to retain the blade 34 in the extended position. In other embodiments, the pin 42 may extend through the hole 44 and into a cavity (not shown), in the second side 54 of the handle to provide the lock 40 additional support when retaining the blade 34 in the fully extended position. The pin 42 may be attached to the end 60 of the portion 58 using any desired fastening technique. For example, in an embodiment the pin 42 may be integral with the portion 58, that is not releasably attached. In other embodiments, the pin 42 may be releasably attached to the end 60 with convention fasteners.

Still referring to FIG. 1, the blade 34 includes the tang 36, and an edge 64 to cut materials as desired. The tang 36 may be attached to one or both of the sides using any desired fastening techniques. For example in an embodiment, an axle 66 attaches the tang 36 to both sides 52 and 54. The cavity 44 may be any desired shape that permits the pin 42 to be inserted into it, and may extend any desired depth into the tang 36, which includes through the tang 36. For example in an embodiment, the cavity 44 may be a circular hole 44. The hole 44 may be located anywhere on the tang 36 as desired as long as the central axis 46 is further away from the pivot axis 48 than the end 50 of the handle 32 is. For example, in an embodiment the hole 44 is located relative to the pivot axis 48 so that the pin 42 may be inserted into the hole 44 when the blade extends substantially 180 degrees relative to the handle 32. In other embodiments, the blade 34 may be locked in other extended positions. For example, the blade may be locked in a position such that the blade 34 extends substantially 90 degrees relative to the handle 32.

The lock 40 may also retain the blade 34 in a retracted position if desired. For example, in an embodiment the tang 36 may include another cavity 68 (here a hole) configured to receive the pin 42 and located relative to the pivot axis 48 so that the pin 42 may be inserted into the hole 68 when the blade 34 extends substantially 0 degrees relative to the handle 32 (the fully retracted position). In the fully retracted position, the edge 64 of the blade 34 lies between the first and second sides 52 and 54 of the handle 32 to conceal the edge 64 and prevent it from cutting. In other embodiments, the blade 34 may be locked in other retracted positions. For example, the blade 34 may be locked in a position such that the blade extends substantially 20 degrees relative to the handle 32. In still other embodiments, the tang 36 may not include another cavity 68 to receive the pin 42, but the pin 42 may contact the surface of the tang 36 and hold with friction the blade 34 in the retracted position.

Still referring to FIG. 1, the knife 30 may also include a groove 70 and a pin 72 to limit the range of the blade's movement relative to the handle 32. The groove 70 has a first end 74 that the pin 72 contacts when the blade 34 is in the fully extended position, and a second end 76 that the pin 72 contacts when the blade 34 is in the fully retracted position. Other embodiments for limiting the range of the blade's movement are possible. For example, a conventional thumb-stud extending from the blade 34 may contact the end 50 to limit the range of the blade's movement.

FIG. 2A is a view of the folding knife 30 in FIG. 1 with the blade 34 locked in an extended position according to an embodiment of the invention. FIG. 2B is a view of the folding knife 30 in FIG. 1 with the blade 34 locked in a fully retracted position according to an embodiment of the invention. When the blade 34 is in the fully extended position, the pin 42 is disposed in the hole 44, and when the blade 34 is in the fully retracted position, the pin 42 is disposed in the hole 68. To release the blade 34 from the lock 40 and move the blade 34 to the fully extended position, one first moves the end 60 of the portion 58 away from the tang 36 to withdraw the pin 42 from the hole 44. Next, one pivots the tang 36 about the pivot axis 48. When the blade 34 is in the fully extended, the portion 58 and/or region 62 urges the pin 42 into the hole 44 to retain the blade 34 in the fully extended position.

To reposition the blade 34 from the fully extended position to the fully retracted position, one can follow the same procedure. In other embodiments, the procedure can be used to reposition the blade 34 from a different extended position to a different retracted position, and from a different retracted position to a different extended position.

FIG. 3 is an exploded, perspective view of a folding knife 80 according to another embodiment of the invention. In this embodiment, the knife 80 is similar to the knife 30 shown in FIG. 1. The knife 80, however, includes a tang 82 having a second cavity 84, and a lock 86 having a second pin 88 that may be inserted into the second cavity 84 to retain the blade 90 in an extended position, such as a fully extended position (as shown) or a retracted position. With the lock 86 contacting the blade 90 at more than one location on the tang 82, the lock 86 can securely retain the blade 90 when significant torque is applied to the blade 90.

The second cavity 84 may be located in the tang 82 as desired, and the second pin 88 may located in the handle 92 as desired. For example, in an embodiment, the second cavity 84 is located on the side of the tang 82 that is opposite the side where the first cavity 94 is located. The second cavity 84 is also aligned with the first cavity 94, and each cavity 84 and 94 is configured to generate one hole through the tang 82. The second pin 88 is located in the second side 96 of the handle 92 and extends from a second portion 98. When the lock 86 retains the blade 90 in the fully extended position, the first and second pins 100 and 88 are disposed in hole.

Other embodiments are possible. For example, the depth of the second cavity 84 may not extend to the depth of the first cavity 94 to generate the hole through the tang 82. Also, the second cavity 84 may be located on the same side of the tang 82 as the first cavity 94, and the corresponding second pin 88 may extend from the same portion 102 as the first pin 100 or from a different portion located on the first side 104. Also, the lock 86 may include more than two pins, and the tang 82 may include more than two cavities that correspond with the pins.

Figure 4:
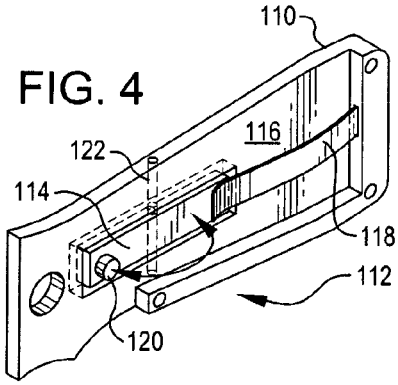
FIG. 4 is a perspective view of a handle and lock according to another embodiment of the invention.

FIG. 4 is a perspective view of a handle side 110 and lock 112 according to another embodiment of the invention. The handle side 110 and the lock 112 in this embodiment are similar to the handle side 52 (FIG. 1) and lock 40 (FIG. 1) except the portion 114 is pivotally attached to the body 116, and a spring 118 urges the pin 120 toward the tang (not shown) of the blade (no shown). The portion 114 may be pivotally attached to the body 116 as desired to provide a desired force. For example, in an embodiment the handle side 110 includes an axle 122 that passes through the portion 114 midway between the pin 120 and the location where the spring 118 contacts the portion 114. The location of the axle 122 relative to the pin 120 and where the spring 118 contacts the portion 114 may be any location desired to provide a force applied to the pin 120 to keep the pin 120 in the cavity 44 (FIG. 1). The distance between the axle 122 and the pin 120 relative to the distance between axle 122 and where the spring 118 contacts the portion 114 affects the amount of force applied to the pin 120 to keep the pin 120 in the cavity 44 (FIG. 1). When the distance between the axle 122 and the pin 120 is less than the distance between the axle 122 and where the spring 118 contacts the portion 114, the force applied to the pin 120 is greater than the force that the spring 118 applies to the portion 114. And, when the distance between the axle 122 and the pin 120 is more than the distance between the axle 122 and where the spring 118 contacts the portion 114, the force applied to the pin 120 is less than the force that the spring 118 applies to the portion 114.

Other embodiments are possible. For example, the spring 118 may be a coiled torsion spring or a bevel spring.

Figure 5:
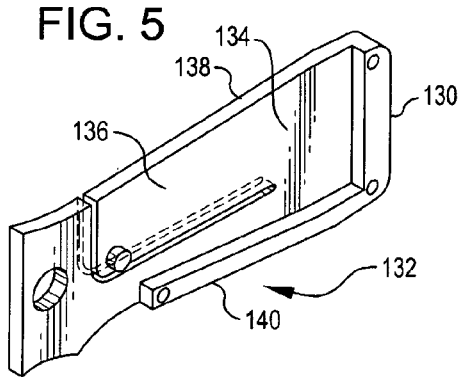
FIG. 5 is a perspective view of a handle and lock according to another embodiment of the invention.

FIG. 5 is a perspective view of a handle side 130 and lock 132 according to another embodiment of the invention. The handle side 130 and lock 132 in this embodiment are similar to the handle side 52 (FIG. 1) and lock 40 (FIG. 1) except the region 134 of the handle side 130 that the portion 136 extends from extends to the edge 138 of the handle side 130. In other embodiments, the region 134 may extend to other edges of the handle side 130, such as the edge 140.

Figure 6:
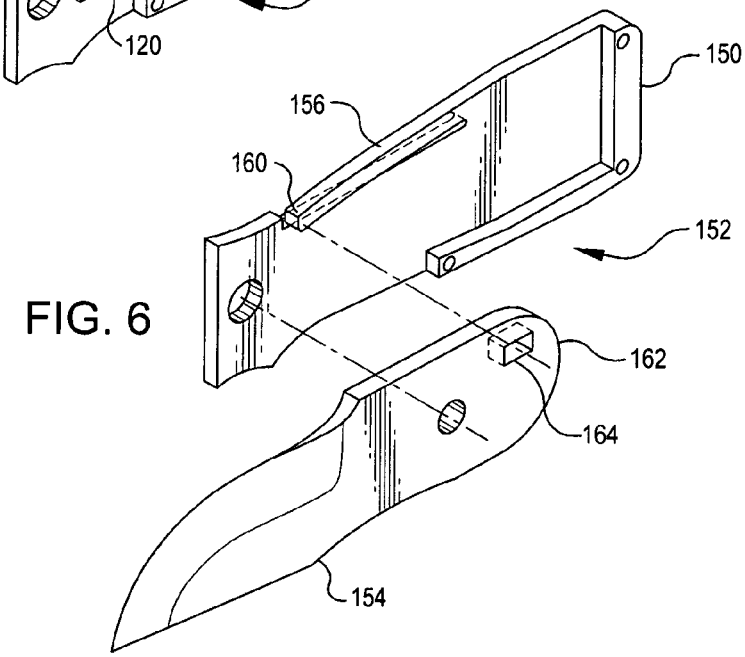
FIG. 6 is an exploded, perspective view of a handle side and a blade of a folding knife, according to another embodiment of the invention.

FIG. 6 is an exploded, perspective view of a handle side 150, lock 152 and a blade 154 according to another embodiment of the invention. In this embodiment, the handle side 150 and lock 152 are similar to the handle side 130 (FIG. 5), and the blade 154 is similar to the blade 34 (FIG. 1). The lock 152 includes a portion 156 whose end 160 is analogous to the pin 42 (FIG. 1). The blade 154 has a tang 162 that includes a rectangular-shaped cavity 164 extending through the tang 162. When the lock 152 retains the blade 154 in an extended position, the end 160 is inserted into a rectangular-shaped cavity 164 and may or may not extend through the tang 162 and into a cavity (not shown) located in a handle side (not shown).

Figure 7:
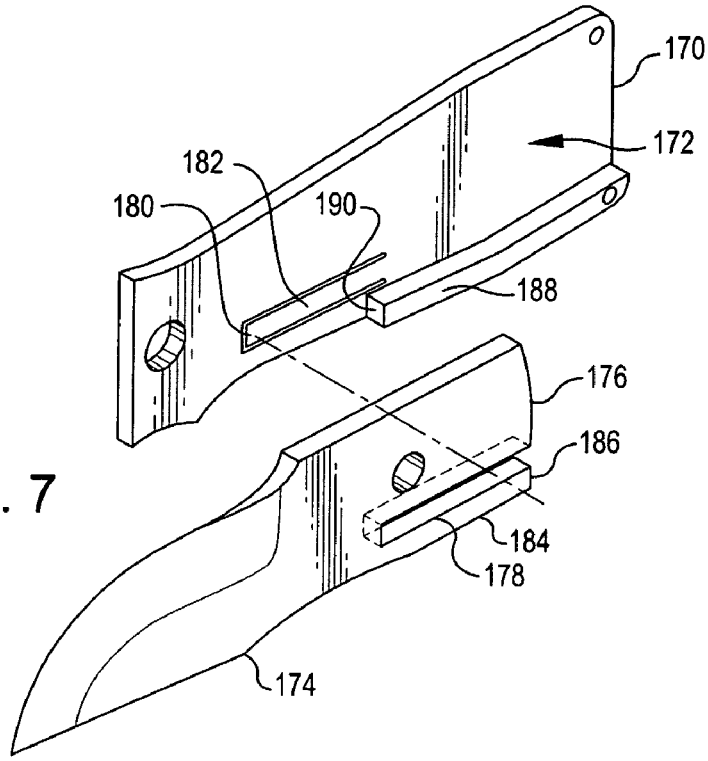
FIG. 7 is an exploded, perspective view of a handle side and a blade of a folding knife, according to another embodiment of the invention.

FIG. 7 is an exploded, perspective view of a handle side 170, a lock 172 and a blade 174, according to another embodiment of the invention. In this embodiment, the lock 172 is similar to the lock 152 (FIG. 6). The blade 174 is similar to the blade 154 (FIG. 6); however, the blade 174 includes a tang 176 that has a slot 178 that receives the end 180 of the portion 182 when the blade 174 is retained in the extended position. The tang 176 also includes a bar 184 having a surface 186. The handle side 170 is similar to the handle side 52 (FIG. 1); however, the handle side 170 includes a lip 188. The lip 188 has a surface 190 that contacts the surface 186 of the bar 184 when the blade 174 is in a fully extended position to prevent the blade 174 from pivoting beyond the position.

Figure 8:
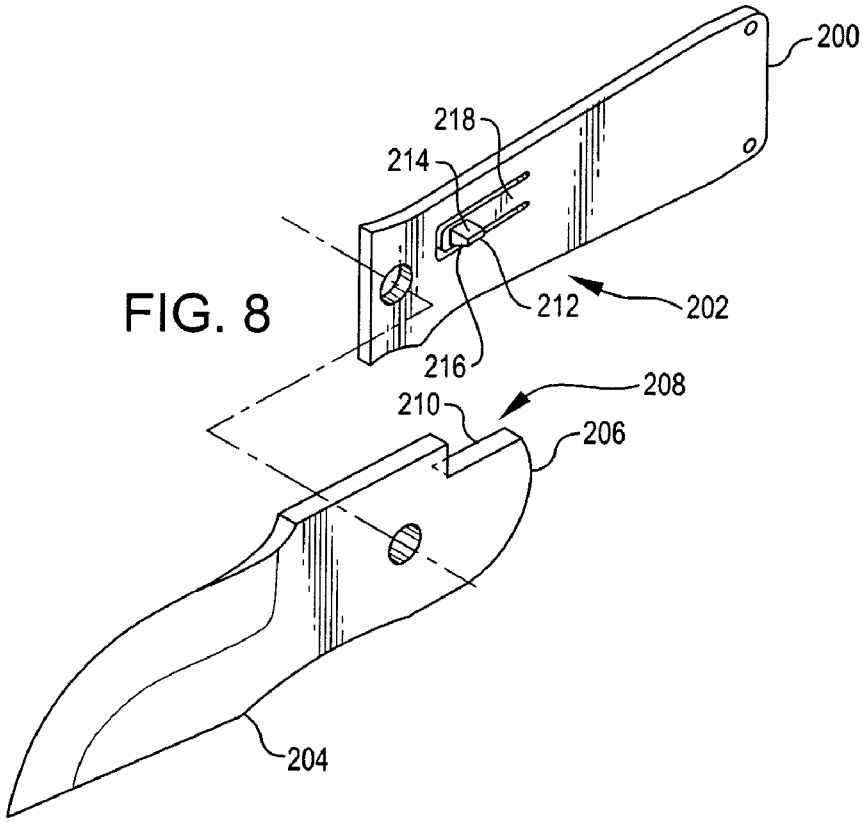
FIG. 8 is an exploded, perspective view of a handle side and a blade of a folding knife, according to another embodiment of the invention.

FIG. 8 is an exploded, perspective view of a handle side 200, lock 202 and a blade 204, according to another embodiment of the invention. In this embodiment, the handle side 200 is similar to the handle side 52 (FIG. 1). The blade 204 is similar to the blade 174 (FIG. 7), and the lock 202 is similar to the lock 40 (FIG. 1). The blade 204, however, includes a tang 206 whose cavity is configured to form a step 208 having a surface 210. The lock 202, also, includes a block 212 configured to direct the block 212 away from the tang 206 as the blade 204 is pivoted toward the extended position and retain the blade 204 once the blade 204 reaches the extended position.

The block 212 can be configured as desired to provide these two functions. For example, in an embodiment the block 212 includes a first surface 214 that the tang's surface 210 contacts to retain the blade 204 when the blade 204 is in the extended position. The block 212 also includes a second surface 216 that is substantially flat, sloped about 45° relative to the first surface 214, and that contacts the tang 206 as the blade 204 is pivoted toward the extended position. After contact, as the blade 204 continues toward the extended position, the tang 206 pushes the block 212 out of the way. Then, when the blade 204 is in the extended position, the portion 218 urges the block 212 back and over the tang's surface 210 so that the surface 210 can contact the first surface 214 to retain the blade 204.

Other embodiments are possible. For example, the second surface 216 may be sloped more or less than 45°. The second surface 216 may also be contoured, that is not substantially flat.

Figure 9A:
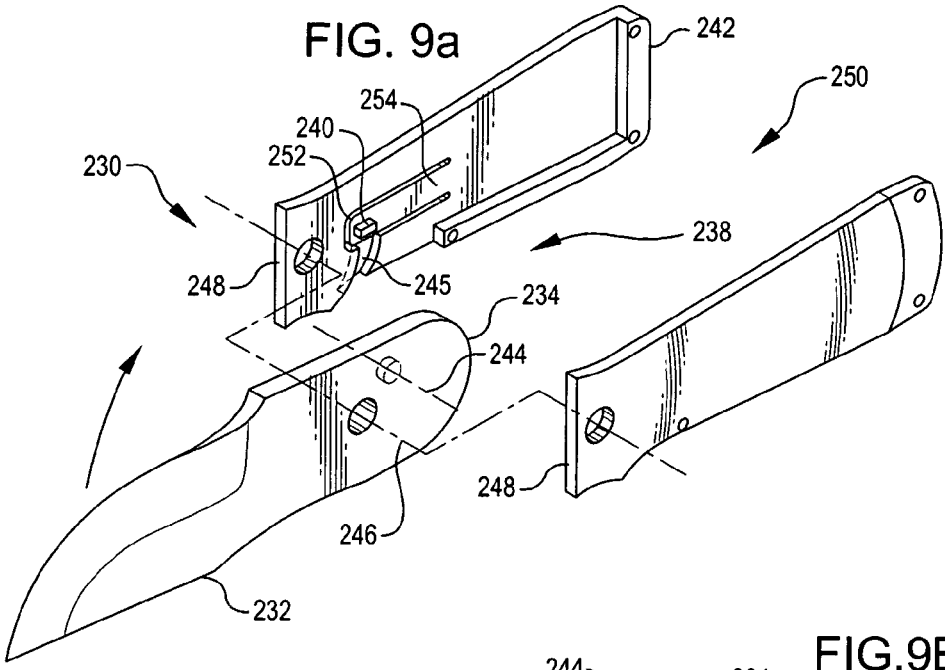
FIG. 9A is an exploded, perspective view of a folding knife according to another embodiment of the invention.
Figure 9B:
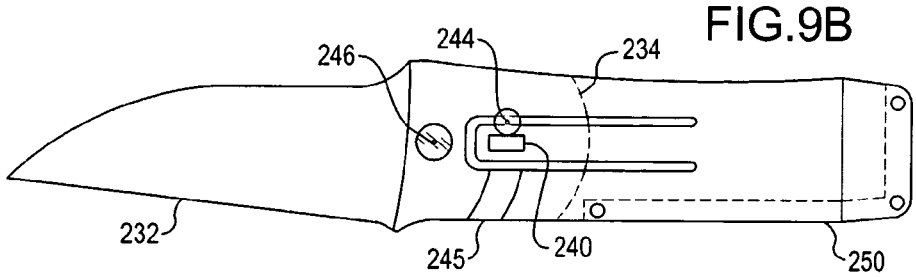
FIG. 9B is a side view of the knife in FIG. 11 with the blade locked in an extended position according to an embodiment of the invention.

FIG. 9A is an exploded, perspective view of a folding knife 230 according to an embodiment of the invention. The knife 230 is similar to the knife 30 (FIG. 1). The knife 230, however, includes a blade 232 whose tang 234 has a pin 236, and a lock 238 having a block 240 that is positioned over the pin 236 and contacts the pin 236, as shown in FIG. 9B, to retain the blade 232 in the extended position. To allow the pin 236 to be located where the block 240 can retain the pin 236, the handle side 242 includes a groove 245.

The pin 236 may be any desired shape that permits the block 240 to be positioned over it when the blade 232 is in the extended position, and may extend any desired length. For example, in an embodiment, the pin 236 may be cylindrical and may extend a length that is less than the thickness of the handle side 242. The pin 236 may be located anywhere on the tang 234 as desired as long as the central axis 244 is further away from the pivot axis 246 than the end 248 of the handle 250 is. For example, in an embodiment the pin 236 is located relative to the pivot axis 246 so that the block 240 may be positioned over the pin 236 when the blade 232 extends substantially 180 degrees relative to the handle 250. In other embodiments, the blade 232 may be locked in other extended positions. For example, the blade 232 may be locked in a position such that the blade 232 extends substantially 90 degrees relative to the handle 250.

The block 240 may be any desired shape that allows it to be positioned over the pin 236. For example, in an embodiment the block 240 is rectangular and extends the diameter of the pin 236. In other embodiments, the block 240 may include a surface (not shown) contoured to match the surface of the pin 236 that the block 240 contacts to retain blade 232 in the extended position. The block 240 may be attached to the end 252 of the portion 254 using any desired fastening technique. For example, in an embodiment the block 240 may be integral with the portion 254. In other embodiments, the block 240 may be releasably attached to the end 252 with conventional fasteners.

Figure 10:
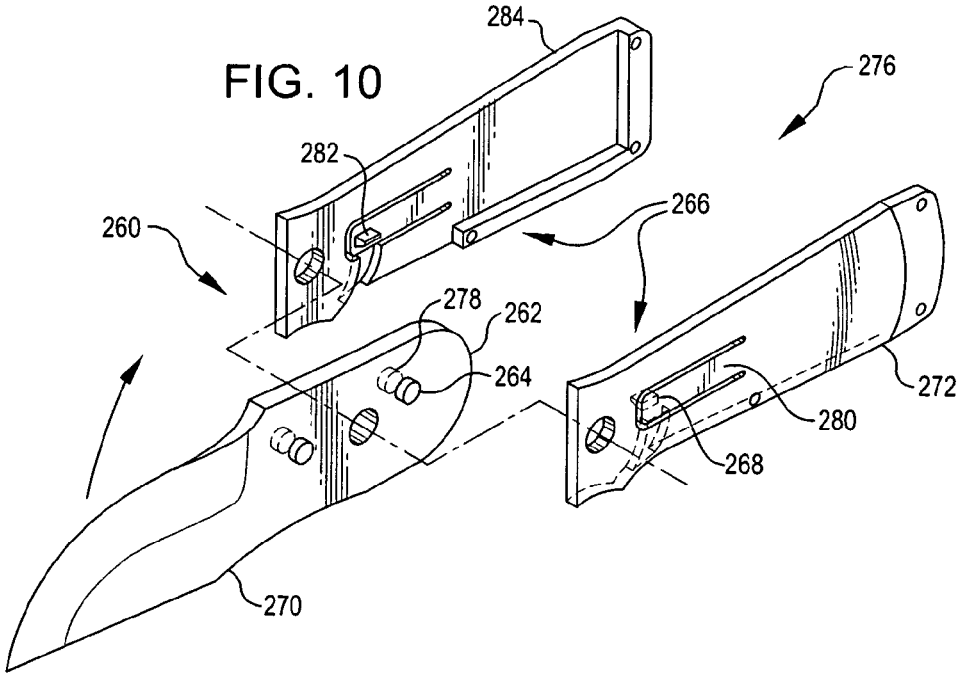
FIG. 10 is an exploded, perspective view of a folding knife according to another embodiment of the invention.

FIG. 10 is an exploded, perspective view of a folding knife 260 according to another embodiment of the invention. In this embodiment, the knife 260 is similar to the knife 230 shown in FIGS. 9A and 9B. The knife 260, however, includes a tang 262 having a second pin 264, and a lock 266 having a second block 268 that may be positioned over the second pin 264 to retain the blade 270 in the extended position. To allow the second pin 264 to be located where the block 268 can retain it, the handle side 272 includes a groove similar to groove 245 depicted in FIG. 10. With the lock 266 contacting the blade 270 at more than one location on the tang 262, the lock 266 can securely retain the blade 270 when significant torque is applied to the blade 270.

The second pin 264 may be located in the tang 262 as desired, and the second block 268 may located in the handle 276 as desired. For example, in an embodiment, the second pin 264 is located on the side of the tang 262 that is opposite the side where the first pin 278 is located, and aligned with the first pin 278. The second block 268 is located in the second side 272 of the handle 276 and extends from a second portion 280. When the lock 266 retains the blade 270 in the fully extended position, the first and second blocks 282 and 268 are positioned over their corresponding pins 278 and 264.

Other embodiments are possible. For example, the second pin 264 may be located on the same side of the tang 262 as the first pin 278, and the corresponding second pin 264 may extend from the same portion as the first block 282 or from a different portion located on the first side 284. Also, the lock 266 may include more than two pins, and the tang 262 may include more than two cavities that correspond with the pins.

Figure 11:
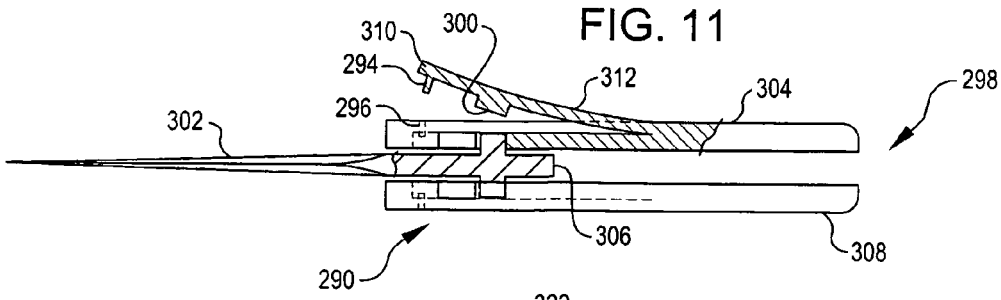
FIG. 11 is a view of a folding knife according to another embodiment of the invention.

FIG. 11 is a view of a folding knife 290 according to another embodiment of the invention. In this embodiment, the knife 290 is similar to the knife 260 shown in FIG. 10. The knife 290, however, includes a lock having a locking pin 294 that is inserted into a locking cavity 296 in the handle 298 to support the block 300 as it retains the blade 302 in the extended position.

The locking pin 294 may be any desired shape that allows it to be inserted into the locking cavity 296. For example, in an embodiment, the locking pin 294 is cylindrical and extends a distance less than the thickness of the handle side 304. In other embodiments, the locking pin 294 may extend through the handle side 304 and into a cavity (not shown) in the tang 306, or through the handle side 304 and tang 306, and into the handle side 308 to provide the block 300 additional support when retaining the blade 302 in the extended position. The locking pin 294 may be attached to the end 310 of the portion 312, or any other location on the portion 312, using any desired fastening technique. For example, in an embodiment the locking pin 294 may be integral with the portion 312. In other embodiments, the pin 294 may be releasably attached to the end 310 with conventional fasteners.

The locking cavity 296 may be any desired shape that permits the locking pin 294 to be inserted into it, and may extend any desired depth into the handle side 304, which includes through the handle side 304. For example, in an embodiment, the locking cavity 296 may be a circular hole.

Figure 12:
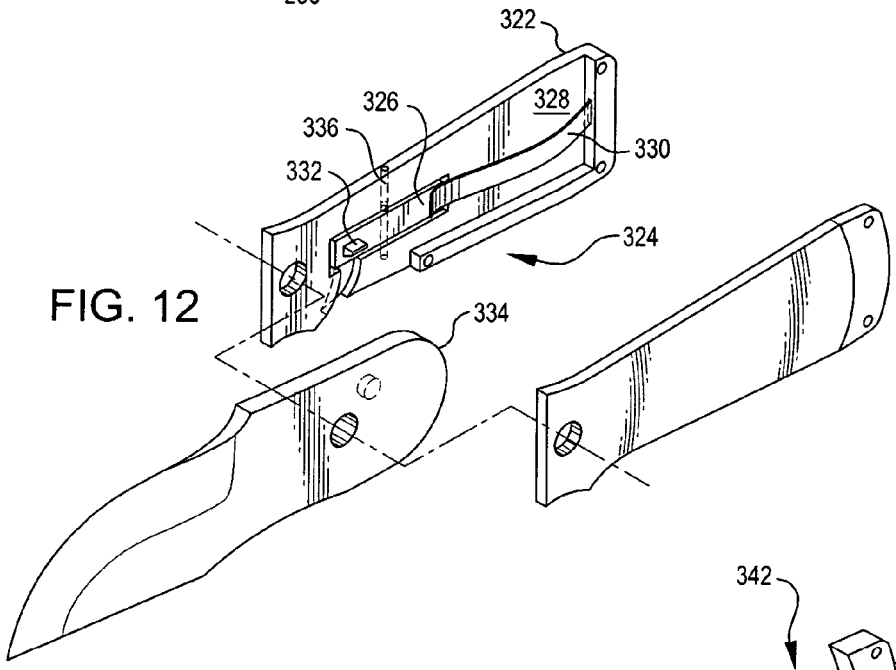
FIG. 12 is a perspective view of a handle and lock according to another embodiment of the invention.

FIG. 12 is a perspective view of a folding knife according to another embodiment of the invention. In this embodiment, the knife is similar to the knife 260 shown in FIG. 10. The knife, however, includes a handle side 322 similar to the handle side 110 shown in FIG. 4, and a lock 324 similar to the lock 112 shown in FIG. 4. The lock 324 includes a portion 326 pivotally attached to the body 328 of the handle side 322, and a spring 330 that urges the block 332 toward the tang 334.

The portion 326 may be pivotally attached to the body 328 as desired to provide a desired force. For example, in an embodiment, the handle side 322 includes an axle 336 that passes through the portion 326 midway between the block 332 and the location where the spring 330 contacts the portion 326. The location of the axle 336 relative to the block 332 and where the spring 330 contacts the portion 326 may be any location desired to provide a force applied to the block 332 to keep the block 332 positioned over the pin. When the distance between the axle 336 and the block 332 is less than the distance between the axle 336 and where the spring 330 contacts the portion 326, the force applied to the block 332 is greater than the force that the spring 330 applies to the portion 326. And, when the distance between the axle 336 and the block 332 is more than the distance between the axle 336 and where the spring 330 contacts the portion 326, the force applied to the block 332 is less than the force that the spring 330 applies to the portion 326.

Other embodiments are possible. For example, the spring 330 may be a coiled torsion spring or a bevel spring.

Figure 13:
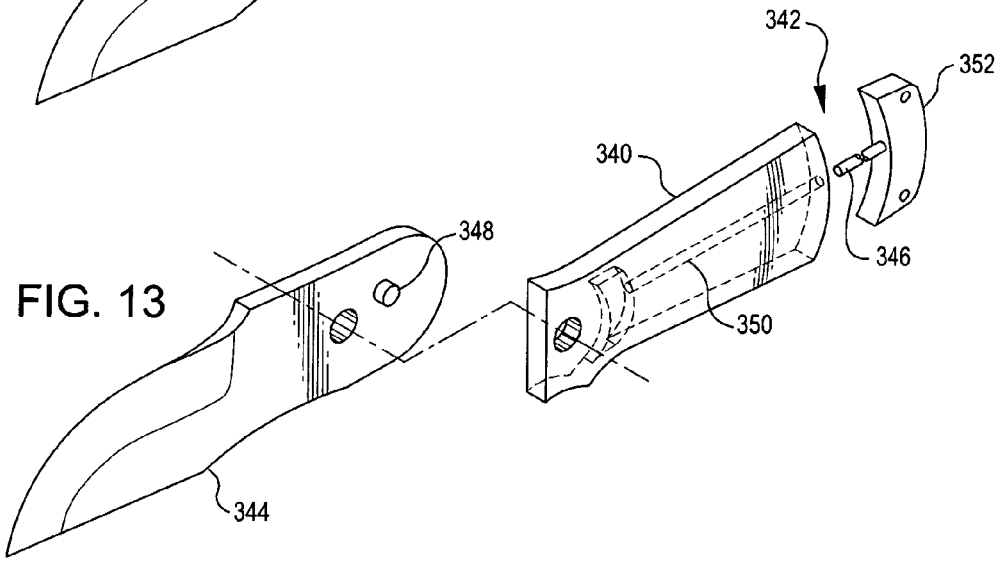
FIG. 13 is an exploded, perspective view of a handle side and a blade of a folding knife, according to another embodiment of the invention.

FIG. 13 is an exploded, perspective view of a handle side 340, lock 342, and a blade 344, according to another embodiment of the invention. In this embodiment, the handle side 340 is similar to the handle side 242 (FIG. 9A), and the blade 344 is similar to the blade 323 (FIG. 9A). The lock 342 includes a rod 346 that is moved in a direction along the length of the handle side 340 to position the rod 346 over the pin 348 to retain the blade 344 in the extended position. The handle side 340 includes a passage 350 to hold the rod 346 as the rod 346 is moved relative to the handle side 340 and as the rod 346 contacts the pin 348 to retain the blade 344 in the extended position. When the rod 346 is positioned over the pin 348, one pulls the handle butt 352 away from the handle side 340 to move the rod 346 away from the pin 348. With the rod 346 withdrawn, one can then pivot the blade 344 to another desired extended or retracted position. To retain the blade 344 in the extended position, one pivots the blade 344 to the position and pushes the handle butt 352 toward the handle side 340 to position the rod 346 over the pin 348.

Figure 14:
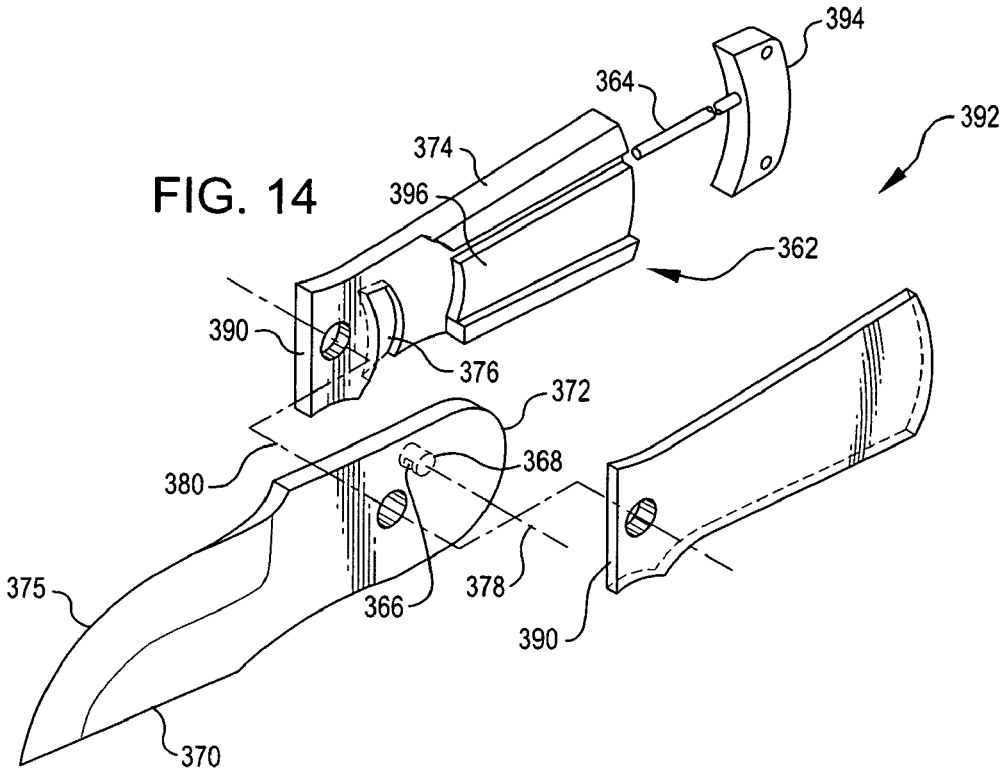
FIG. 14 is an exploded, perspective view of a folding knife, according to another embodiment of the invention.

FIG. 14 is an exploded, perspective view of a folding knife, according to another embodiment of the invention. The knife includes a lock 362 having a rod 364 that is inserted into a slot 366 of a pin 368 of the blade 370 to retain the blade 370 in the extended position. The knife is similar to the knife 230 (FIGS. 9A and 9B), and the lock 362 is similar to the lock 342 (FIG. 13). The knife, however, includes a blade 370 whose tang 372 has a pin 368 that includes the slot 366. To allow the pin 368 to be located where the rod 364 can retain the pin 368, the handle side 374 includes a groove 376.

The slot 366 may be any desired shape that permits the rod 364 to be inserted into it when the blade 370 is in the extended position, and the pin 368 may extend any desired length. For example, in an embodiment, the slot 366 may open away from the cutting edge 375 of the blade 370, and the pin 368 may extend a length that is less than the thickness of the handle side 374. The pin 368 may be located anywhere on the tang 372 as desired as long as the central axis 378 is further away from the pivot axis 380 than the end 390 of the handle 392 is. For example, in an embodiment the pin 368 is located relative to the pivot axis 380 so that the rod 364 may be inserted into the slot 366 when the blade 370 extends substantially 180 degrees relative to the handle 392. In other embodiments, the blade 370 may be locked in other extended positions. For example, the blade 370 may be locked in a position such that the blade 370 extends substantially 90 degrees relative to the handle 392.

The rod 364 may be any desired shape that allows it to be inserted into the slot 366. For example, in an embodiment the rod 364 is cylindrical. In other embodiments, the rod 364 may include a surface (not shown) contoured to match the surface of the slot 366 that the rod 364 contacts to retain blade 370 in the extended position. The rod 364 may be attached to the handle butt 394 using any desired fastening technique. For example, in an embodiment the rod 364 may be integral with the handle butt 394. In other embodiments, the rod 364 may be releasably attached to the handle butt 394 with conventional fasteners.

Still referring to FIG. 14, the lock 362 may also include a support 396 to hold the rod 364 as the rod 364 is moved relative to the handle side 374 and support the rod 364 as the rod 364 contacts the pin 368 in the slot 366 to retain the blade 370 in the extended position. The support 396 may extend a small or a large portion of the length of the handle side 374 as desired. If the support 396 extends a small portion of the handle side's length then the support 396 may be located anywhere along the length as desired. However, the closer the support 396 is to the pin 368 the better the support that it can provide.

When the rod 364 is inserted into the slot 366, one pulls the handle butt 394 away from the handle side 374 to move the rod 364 away from the slot 366. With the rod 364 withdrawn, one can then pivot the blade 370 to another desired extended or retracted position. To retain the blade 370 in the extended position, one pivots the blade 370 to the position and pushes the handle butt 394 toward the handle side 374 to insert the rod 364 into the slot 366.

Figure 15:
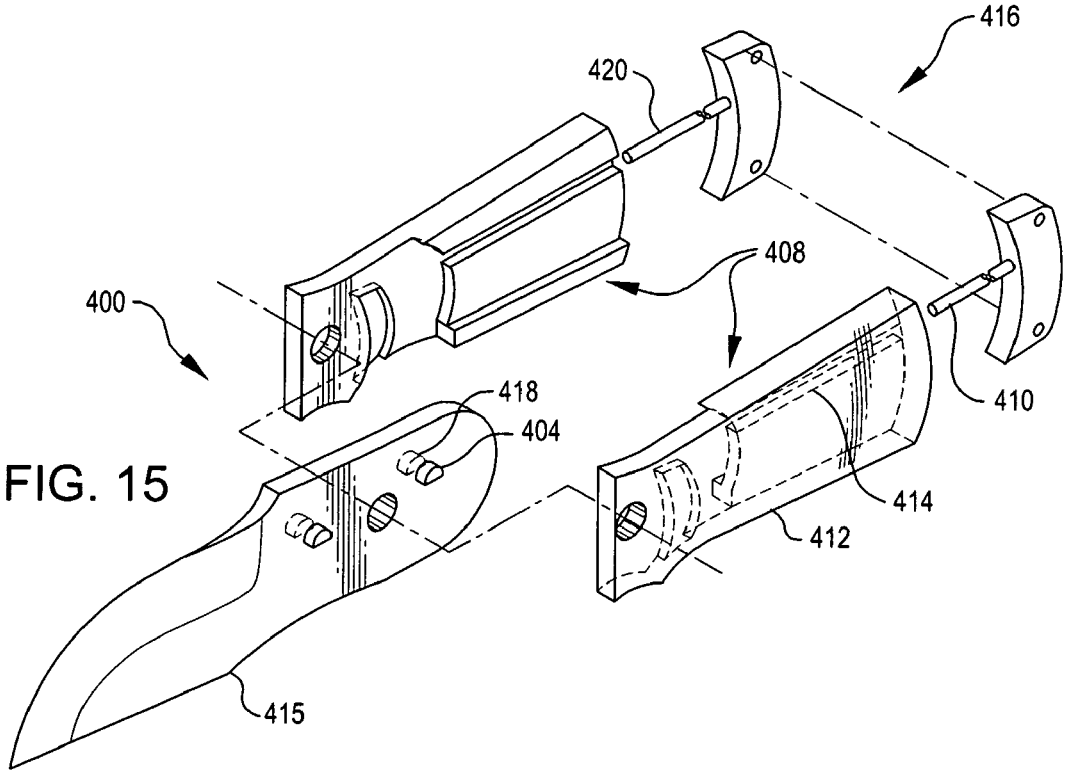
FIG. 15 is an exploded, perspective view of a folding knife according to another embodiment of the invention.

FIG. 15 is an exploded, perspective view of a folding knife 400 according to another embodiment of the invention. In this embodiment, the knife 400 is similar to the knife in FIG. 14. The knife 400, however, includes a tang having a second pin 404 that includes a second slot, and a lock 408 having a second rod 410 that is inserted into the second slot of the second pin 404 to retain the blade 415 in the extended position. To allow the second pin 404 to be located where the second rod 410 can retain it, the handle side 412 includes groove 414. With the lock 408 contacting the blade 415 at more than one location on the tang, the lock 408 can securely retain the blade 415 when significant torque is applied to the blade 415.

The second pin 404 may be located in the tang 402 as desired, and the second rod 410 may located in the handle 416 as desired to correspond with the second slot 406. For example, in an embodiment, the second pin 404 is located on the side of the tang 402 that is opposite the side where the first pin 418 is located, and aligned with the first pin 418. The second rod 410 is located in the second side 412 of the handle 416. When the lock 408 retains the blade 415 in the fully extended position, the first and second rods 420 and 410 are inserted into their corresponding slots.

Other embodiments are possible. For example, the second pin 404 may be located on the same side of the tang 402 as the first pin 418, and the corresponding second rod 410 may be located in the same handle side as the first rod 420.

FIGS. 16A-16E are views of slots 430(*a-e*) and 432(*a-e*) of the tang in FIG. 15 shown in different configurations and orientations relative to the edge 434 of the blade 436, according to other embodiments of the invention. Each of the FIGS. 16A-16E shows a blade 436*a*-436*e*, having an edge 434*a*-434*e*, a first slot 430*a*-430*e*, a second slot 432*a*-432*e*, and the end of the rods 438 and 440 disposed in their respective slots when the blade is retained in an extended position.

Figure 16A:
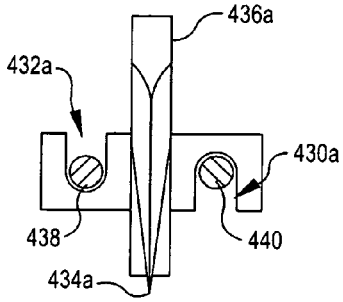
FIGS. 16A-16E are views of pin slots of the tang of a blade in different orientations relative to the edge of the blade, according to other embodiments of the invention.
Figure 16B:
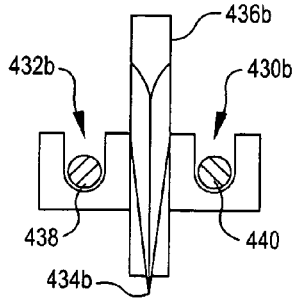
Figure 16C:
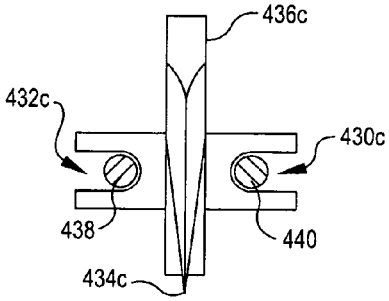
Figure 16D:
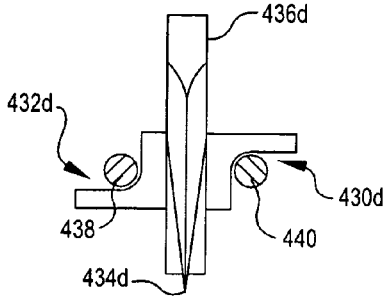
Figure 16E:
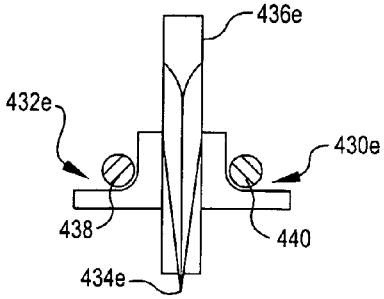
Figure 17:
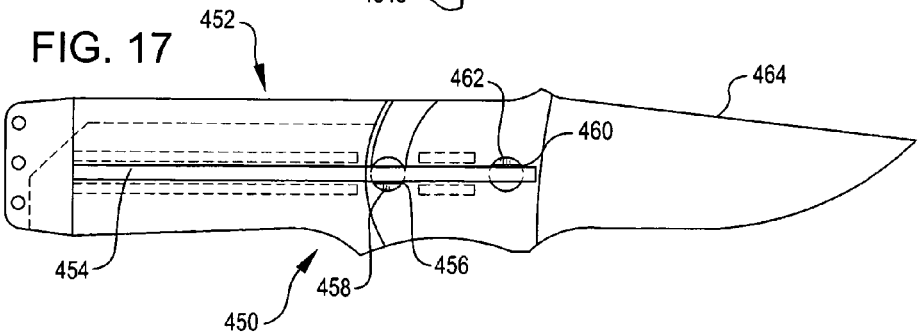
FIG. 17 is a view of a folding knife according to another embodiment of the invention.

FIG. 17 is a view of a folding knife 450 according to another embodiment of the invention. In this embodiment, the knife 450 is similar to the knife in FIG. 14. The knife 450, however, includes a lock 452 having a rod 454 that extends through the slot 456 of the pin 458 and is inserted into the slot 460 of the axle 462 to support the rod 454 as it retains the blade 464 in an extended position. The slot 456 is similar to the first slot 430*d* (FIG. 16D), and the axle's slot 460 is similar to the second slot 432*d* (FIG. 16D). Other slot configurations and orientations are possible. For example, the slot 456 may be similar to the first slot 430*a* (FIG. 16A), and the axle's slot 460 may be similar to the second slot 432*a* (FIG. 16A).

The scope of the present systems and methods includes both means-plus-function and step-plus-function concepts. However, the terms set forth in this application are not to be interpreted in the claims as indicating a "means plus function" relationship unless the word "means" is specifically recited in a claim, and are to be interpreted in the claims as indicating a "means plus function" relationship where the word "means" is specifically recited in a claim. Similarly, the terms set forth in this application are not to be interpreted in method or process claims as indicating a "step plus function" relationship unless the word "step" is specifically recited in the claims, and are to be interpreted in the claims as indicating a "step plus function" relationship where the word "step" is specifically recited in a claim.

From the foregoing, it will be appreciated that, although specific embodiments have been discussed herein for purposes of illustration, various modifications may be made without deviating from the spirit and scope of the discussion herein. Accordingly, the systems and methods include such modifications as well as all permutations and combinations of the subject matter set forth herein and are not limited except as by the appended claims.

What is claimed is:

1. A knife comprising:

a handle having a first end;

a blade including:

a tang attached to the handle and pivotable relative to the handle about a pivot axis to move the blade to an extended position extending from the first end and a retracted position, the tang having a cavity positioned between a free end of the tang and the pivot axis and including a central axis parallel or substantially parallel with the pivot axis and located a distance away from the pivot axis that is greater than the distance between the pivot axis and the first end of the handle, and an edge configured to be exposed for cutting when the blade is in the extended position and to be concealed to prevent cutting when the blade is in the retracted position; and a lock including a pin moveable relative to the handle and insertable into the cavity to retain the blade in the extended position, wherein the pin extends from a portion of the handle that is elastically bendable and configured to urge the pin toward the tang.

2. The knife of claim 1 wherein the pin is an end of the handle portion and insertable into the cavity of the tang.

3. A knife comprising:

a handle having a first end;

a blade including:

a tang attached to the handle and pivotable relative to the handle about a pivot axis to move the blade to an extended position extending from the first end and a retracted position, the tang having a cavity positioned between a free end of the tang and the pivot axis and including a central axis parallel or substantially parallel with the pivot axis and located a distance away from the pivot axis that is greater than the distance between the pivot axis and the first end of the handle, and an edge configured to be exposed for cutting when the blade is in the extended position and to be concealed to prevent cutting when the blade is in the retracted position; and a lock including a pin moveable relative to the handle and insertable into the cavity to retain the blade in the extended position; and wherein the pin extends from a portion of the handle that is pivotally attached to a body of the handle.

4. The knife of claim 3 further comprising a spring to urge the pin toward the tang.

5. The knife of claim 3 wherein the pin is an end of the handle portion and insertable into the cavity of the tang.

* * * * *